US005288136A

United States Patent [19]

Webber et al.

[11] Patent Number: 5,288,136

[45] Date of Patent: Feb. 22, 1994

[54] CHAIR MEMBRANE FASTENER

[75] Inventors: David A. Webber, Zeeland; Steven F. Goodman, Wyoming; Jeffrey S. Wing, Holland, all of Mich.

[73] Assignee: Herman Miller, Inc., Zeeland, Mich.

[21] Appl. No.: 837,369

[22] Filed: Feb. 14, 1992

[51] Int. Cl.[5] ..... A47C 7/00

[52] U.S. Cl. ..... 297/440.11; 297/219.1; 297/452.13

[58] Field of Search ..... 297/441, 219, 218, 457, 297/452, 463, 219.1, 452.13, 452.1, 440.11; 160/385, 394, 398, 400, 404

[56] References Cited

U.S. PATENT DOCUMENTS

| | | |
|---|---|---|
| 1,933,372 | 10/1933 | Fisher . |
| 2,233,986 | 3/1941 | Leech . |
| 3,041,109 | 6/1962 | Eames et al. . |
| 3,208,085 | 9/1965 | Grimshaw . |
| 3,248,147 | 4/1966 | Testa . |
| 3,273,877 | 9/1966 | Geller et al. . |
| 3,298,743 | 1/1967 | Albinson et al. . |
| 3,399,926 | 9/1968 | Hehn . |
| 3,431,022 | 3/1969 | Poppe et al. . |
| 3,601,446 | 8/1971 | Persson . |
| 3,624,814 | 11/1971 | Borichevsky . |
| 3,844,612 | 10/1974 | Borggren et al. . |
| 3,947,068 | 3/1976 | Buhk . |
| 3,999,802 | 12/1976 | Powers . |
| 4,010,980 | 3/1977 | Dubinsky . |
| 4,019,776 | 4/1977 | Takamatsu . |
| 4,036,524 | 7/1977 | Takamatsu . |
| 4,047,756 | 9/1977 | Ney . |
| 4,152,023 | 5/1979 | Buhk . |
| 4,469,738 | 9/1984 | Himelreich, Jr. . |
| 4,545,614 | 10/1985 | Abu-Isa et al. . |
| 4,548,441 | 10/1985 | Ogg . |
| 4,601,516 | 7/1986 | Klein . |
| 4,629,525 | 12/1986 | Rasmussen . |
| 4,796,955 | 1/1989 | Williams . |
| 4,815,789 | 3/1989 | Marcus . |
| 4,826,249 | 5/1989 | Bradbury . |
| 4,842,257 | 6/1989 | Abu-Isa et al. . |
| 4,869,554 | 9/1989 | Abu-Isa et al. . |
| 4,885,827 | 12/1989 | Williams . |
| 4,939,183 | 7/1990 | Abu-Isa et al. . |
| 4,946,224 | 8/1990 | Leib . |

FOREIGN PATENT DOCUMENTS

| | | |
|---|---|---|
| 653100 | 11/1962 | Canada . |
| 0032839 | 1/1981 | European Pat. Off. . |

*Primary Examiner*—Philip C. Kannan

*Attorney, Agent, or Firm*—Varnum, Riddering, Schmidt & Howlett

[57] ABSTRACT

An article of furniture and method for assembling the same are disclosed for use wherein a membrane is supported between two opposing frame members. The membrane is attached to the side frame by a first set of fasteners. Thereafter an elongated strap and an elongated web are attached to the side frame overlying the edge of the membrane The first and second halves of a slide fastener are attached to the longitudinal edges of the web and are selectively interengaged to enclose the fasteners and conceal the same from view. Alternatively, an upholstery pad can be attached to the article of furniture such that it overlies the membrane. A second elongated web is attached to the underside of the pad such that the web is spaced inward from the outboard edge of the pad. The second half of the slide fastener is attached to this second elongated web and is selectively interengaged with the first half of the slide fastener which is fixedly attached to the side frame. The outboard edge of the upholstery pad extends outwardly such that it covers the fasteners and conceals them from view. In another embodiment, the membrane and a first half of the slide fastener are attached by fasteners to the opposing frame members. A fabric strip is attached to the membrane to conceal the fasteners. A second half of a slide fastener is fixedly attached to an upholstery pad. The first and second halves of the slide fastener engage to attach the upholstery pad to the chair and to conceal the fasteners from view. In yet another embodiment, the membrane is attached to the opposing frame members by fasteners. An elongated strip is mounted to the support member such that a portion selectively overlies the fasteners. The elongated strip is preferably mounted in a groove adjacent the edge of the membrane.

20 Claims, 7 Drawing Sheets

CHAIR MEMBRANE FASTENER

BACKGROUND OF THE INVENTION

1. Field of the Invention

This invention relates to an article of furniture with a membrane supported between two supports and, more particularly, to the means for fastening the membrane to the supports.

2. Description of Related Art

A wide variety of chairs and other articles of furniture have a membrane stretched between a supporting frame wherein the membrane supports the occupant of the chair. U.S. Pat. No. 3,624,814 to Borichevsky, issued Nov. 30, 1971 discloses a plurality of support filaments mounted to a chair frame by screws. U.S. Pat. No. 4,152,023 to Buhk, issued May 1, 1979 discloses a plastic shell and an upholstery covering mounted to a chair frame by screws.

Alternatively, a sleeve may be telescopically mounted on opposing side frames, as seen in U.S. Pat. No. 4,601,516 to Klein, issued Jul. 22, 1986 and U.S. Pat. No. 4,826,249 to Bradbury, issued May 2, 1989. Other chairs comprise a membrane or a plurality of filaments mounted to a chair frame by rolling the membrane on a frame member and then restricting rotation of the frame member when the chair is assembled, as seen in U.S. Pat. No. 3,399,926 to Hehn, issued Sep. 3, 1968 and U.S. Pat. No. 4,545,614 to Abu-Isa et al., issued Oct. 8, 1985.

Still other chairs have incorporated grooves or apertures along parallel side frames and a widened edge of the membrane or plastic shell secured within the groove, as seen in U.S. Pat. No. 3,431,022 to Poppe et al., issued Mar. 4, 1969, U.S. Pat. No. 3,298,743 to Albinson et al., issued Jan. 17, 1967, U.S. Pat. No. 3,601,446 to Persson, issued Aug. 24, 1971 and U.S. Pat. No. 3,844,612 to Borggren et al., issued Oct. 29, 1974. In U.S. Pat. No. 3,041,109 to Eames et al., issued Jun. 26, 1962, a web of a chair is mounted between parallel rails which have an outwardly facing groove. The edge web is wrapped 360° around a stiffener element and then inserted into the outboard groove.

Chairs have also utilized slide fasteners or zippers to secure upholstery or seat covers to the chair frame or base. Examples of this are seen in U.S. Pat. No. 4,019,776 to Takamatsu, issued Apr. 26, 1977 and U.S. Pat. No. 2,233,986 to Leech, issued Mar. 4, 1941. In each of these designs, the zipper is exposed to the observer at the edge of the upholstery.

None of the references disclose an article of furniture with a membrane stretched between two support members wherein the fastening means are effectively hidden from view, thereby creating a more aesthetically pleasing appearance. In addition, none of the chairs previously known disclose fastening means for attaching an upholstery pad such that the upholstery hides the fastening means from view. This hidden fastening means also creates a more aesthetically pleasing chair.

SUMMARY OF INVENTION

The article of furniture according to the invention comprises fastening means for securing a membrane to opposing side members wherein the fastening means are effectively hidden from view. In addition, the article of furniture according to the invention has fastening means for mounting an upholstery pad to the article of furniture wherein the fastener is effectively hidden from view, thereby creating an aesthetically pleasing chair.

The invention comprises an article of furniture with two support members which are parallel to and spaced from each other. A membrane having two opposed edges extends between and is attached at the opposed edges to the support members. The membrane supports an occupant. Each of the opposed edges is covered by an elongated web. One half of a slide fastener is attached to one elongated edge of the web and another half of the slide fastener is attached to another elongated edge of the web. The two halves of the slide fasteners are parallel to one another. A plurality of first fasteners mount the web and membrane to one of the support members. The two halves of the slide fasteners are selectively interengagable to conceal the fasteners beneath the edges of the elongated web.

In another embodiment, an elongated strap, overlying and narrower than the web is mounted by said first fasteners to the support members.

In a further embodiment, the article of furniture further comprises a plurality of second fasteners mounting only the membrane to an upper surface of the support members. Preferably, the first and second fasteners comprise staples.

In yet another embodiment, a groove is formed in each of the two support members. The groove receives the opposed edges of the membrane. Preferably, the groove is formed on an upper surface of the support member.

In a further embodiment of the invention, the first fasteners extend the length of the opposed edges of the membrane.

In yet another embodiment, the article of furniture comprises a chair having a seat and a back. Preferably, the membrane is attached to the seat and the back by the first fasteners.

In a further embodiment of the chair, an upholstery pad is mounted to the chair such that the pad conceals the first fasteners and the slide fastener. The chair according to this embodiment comprises a seat, a back, two support members parallel to and spaced from each other for supporting one of said seat and back, and a membrane. The membrane extends between and is fastened at opposed edges to the support members to support an occupant An upholstery pad overlying the membrane is attached to the support members. Each of the opposed edges of the membrane is covered by an elongated first web. The first web has one half of a slide fastener attached to one elongated edge of the first web. The first web is disposed on and parallel to the opposed edge of the membrane. A plurality of first fasteners mount the first web and membrane to the support members. An elongated second web having another half of a slide fastener is attached to one elongated edge of the second web. The elongated second web is securely attached to the upholstery pad. The elongated edge of the first web and one elongated edge of the second web are directed toward each other so that the slide fasteners of the elongated first and second webs can be zipped together. The two halves of the slide fasteners are selectively interengaged or zipped over the first fasteners such that the upholstery pad conceals the first fasteners and slide fastener. The slide fastener fixedly attaches the upholstery pad to the support members.

In a further embodiment, an elongated strap overlies a portion of the first web. The first fasteners extend through the strap and the first web.

In yet another embodiment, the second elongated web is spaced inwardly from an outer edge of the upholstery pad. The first elongated web extends outwardly from an opposed edge of the membrane.

In another embodiment, a plurality of second fasteners are incorporated wherein the second fasteners fasten only the membrane to the support members. Preferably, the first and second fasteners are staples.

In a further embodiment, a groove is formed in each of the support members for receiving the opposed edges of the membrane. Preferably, the groove is formed on an upper surface of the support member.

In yet another embodiment, the fasteners extend along the length of the opposed edges of the membrane except a short distance from a third edge of the membrane. The third edge of the membrane is preferably attached to a transverse member of the chair by a selective fastener.

In a further embodiment of the invention, an elongated strip is utilized to conceal the membrane fasteners from view. The article of furniture according to this embodiment comprises two support members parallel to and spaced from each other and a membrane. The membrane has two opposed edges extending between and attached to the support members to support an occupant. A plurality of fasteners mount the membrane to at least one of these support members. An elongated strip is mounted to the at least one support member and has a portion selectively overlying the fasteners mounting the membrane to the at least one support member.

In yet another embodiment, the at least one support member has an elongated groove adjacent the corresponding edge of the membrane. The elongated strip has a leg which is mounted in the groove. Preferably, the elongated strip is L-shaped.

In an another embodiment, the elongated strip has one or more barbs formed on the leg to resist inadvertent removal of the strip from the groove.

In yet another embodiment, the terminal ends of the elongated strip are attached to the support members by fasteners. Preferably, the fasteners for attaching the elongated strip and the fasteners for attaching the membrane to the support members comprise staples.

The invention further comprises a method for making an article of furniture comprising the steps of first mounting opposed edges of an occupant supporting membrane to two support members. The support members are parallel to and spaced from each other. Secondly, a web having a first half and a second half of a slide fastener is mounted by a plurality of fasteners on the opposed edges of the membrane. Finally, the halves of the slide fastener are selectively interengaged or zipped to conceal the fasteners beneath the slide fasteners and the first and second webs.

In a further embodiment of the invention, the method further comprises the step of fixedly attaching the membrane to the support members by a plurality of second fasteners prior to mounting the webs to the support members.

In yet another embodiment, an elongated strap is mounted to said support members. The strap is disposed on top of the web and parallel to the membrane edges. The web is attached by an plurality of fasteners.

In yet another embodiment of the invention, an upholstery pad is attached to the support members to conceal the fasteners beneath the pad. The pad is attached to the chair by first mounting opposed edges of an occupant support membrane to two support members. The support members are parallel to and spaced from each other. Secondly, a first web having a first half of a slide fastener is mounted by a plurality of first fasteners on the opposed edges of the membrane. Thirdly, a second web having a second half of a slide fastener is mounted by a plurality of second fasteners on the upholstery pad. Finally, the two halves of the slide fastener are selectively interengaged or zipped to attach the upholstery pad to the support members and to conceal the first fasteners beneath the upholstery pad.

BRIEF DESCRIPTION OF THE DRAWINGS

The invention will now be described with reference to the drawings wherein.

DESCRIPTION OF THE PREFERRED EMBODIMENT

Figure 1:
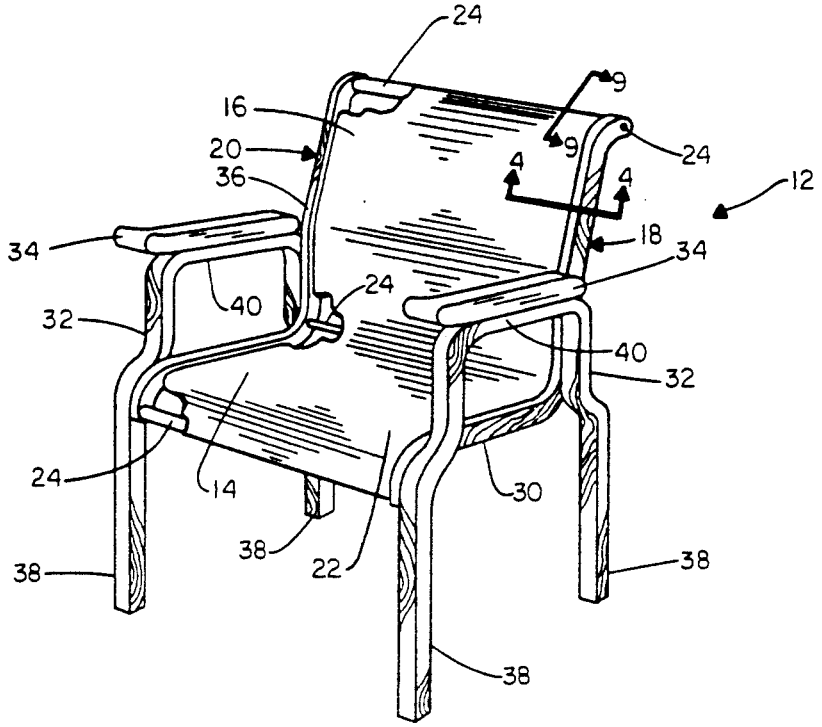
FIG. 1 is a perspective view of a chair according to the invention.

Referring now to the drawings and to FIG. 1 in particular, a chair 12, according to the invention, comprises a seat 14, a back 16, a first support member 18 and a second support member 20. A membrane 22 is mounted to the first and second support members, 18 and 20 by suitable means. Two or more transverse members 24 are fixedly attached to the first and second support members, 18 and 20, and maintain the support members in a parallel, spaced orientation. In the preferred embodiment, transverse members 24 are mounted at the leading edge of the seat 14, at the top edge of the back 16 and at the junction between the seat 14 and back 16.

In the preferred embodiment, the first and second support members, 18 and 20, are mirror images of one another. For simplicity, only the first support member 18 will be described in detail. It will be understood that the second support member 20 is merely a mirror image of the first support member 18.

The first support member 18 comprises a side frame 30, a leg support member 32 and an armrest 34. The side frame is generally L-shaped. However, the leading edge of the seat 14 is curved downwardly and the top edge of the back 16 is curved rearwardly for added comfort for the occupant. In addition, the side frame 30 may have a slight bend 36 adjacent the average occupant's lumbar region for added comfort.

The side frame 30 is fixedly attached to the leg support member 32 by suitable means such as adhesive, screws or bolts. The leg support member 32 is generally U-shaped such that the front and rear legs 38 comprise the vertical legs of the U-shape and the armrest 34 is fixedly attached to the upper surface of the bight portion 40. It is to be understood that extending the leg support member 3 above the seat and incorporating the armrest 34 thereon are not necessary to the invention.

Figure 4:
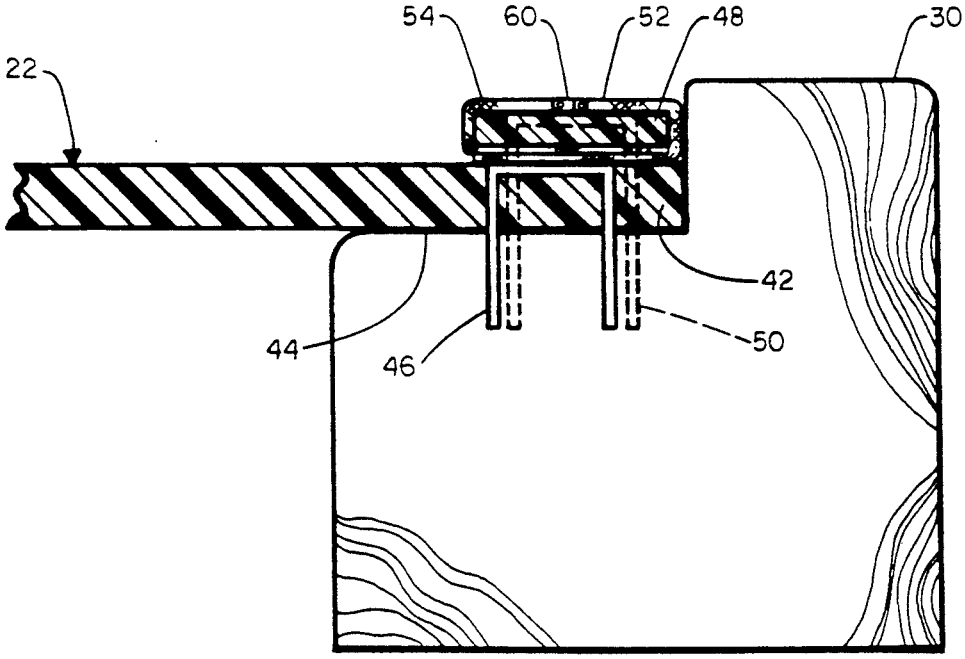
FIG. 4 is a partial sectional view of the membrane fastener according to the invention, taken along lines 4—4 of FIG. 1.
Figure 5:
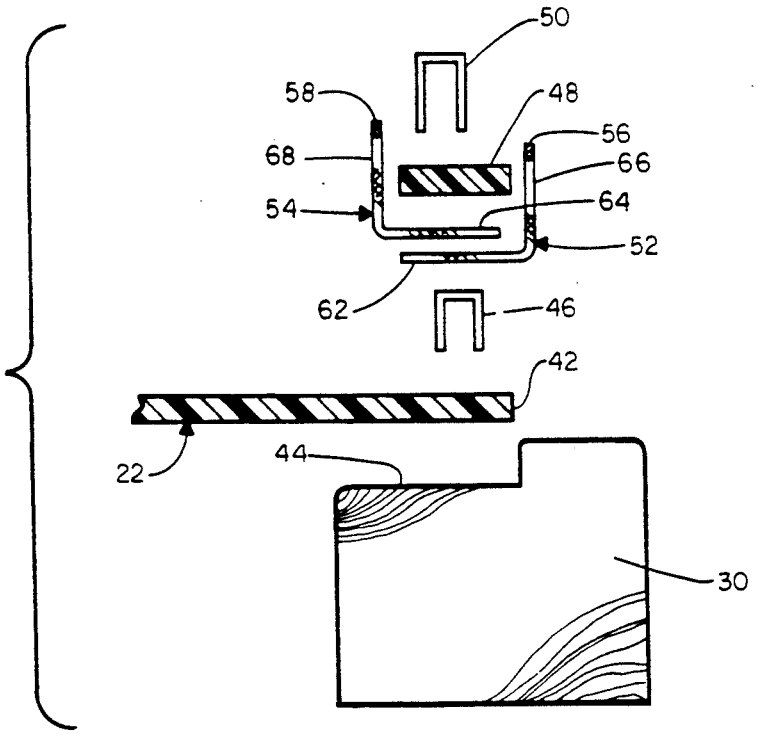
FIG. 5 is an exploded view of the seat membrane fastener as seen in FIG. 4.

The membrane 22 is fastened between the side frames 30 under tension. The membrane 22 provides support for the occupant of the chair 12. As seen in FIGS. 4 and 5, the side frame 30 preferably has a groove 44 formed on the inside, upper surface of the side frame 30. The groove 44 preferably extends the length of the side frame 30. The longitudinal edge 42 of the membrane 22 is fastened within the groove by suitable fastening means. Preferably, the fastening means comprises a plurality of first fasteners such as staples 50, but other suitable fasteners such as snaps, rivets or adhesive are acceptable.

Figure 2:
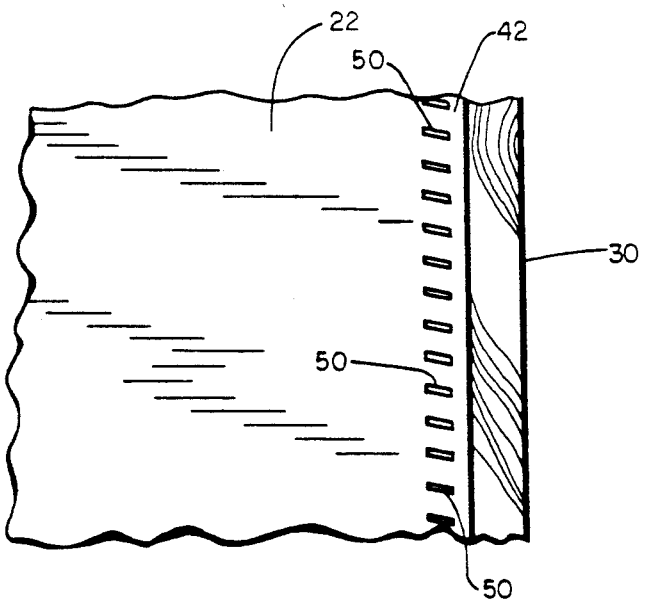
FIG. 2 is a partial elevational view of the membrane mounted to the side frame of the chair according to the invention.

In the first embodiment, the membrane 22 is mounted in the groove 44 by a plurality of second fasteners, such as staples 46. As seen in FIG. 2, the staples 46 are spaced at regular intervals along the edge 42 of the membrane 22. Next, As seen in FIGS. 4 and 5, an elongated strap 48 is mounted on top of the edge 42 of the membrane 22 such that it overlies the row of staples 46 in the groove 44. This elongated strap 48 is fixedly attached to the membrane 22 and the side frame 30 by the first fasteners, staples 50. Other suitable fasteners such as snaps, rivets, or adhesive are acceptable. A first longitudinal edge 62 of a first elongated web 52 and a first longitudinal edge 64 of a second elongated web 54 are stitched to the elongated strap 48. Alternatively, the edges, 62 and 64, of the webs can be sandwiched between the elongated strap 48 and the edge 42 of the membrane 22 and mounted by the staples 50.

Figure 3:
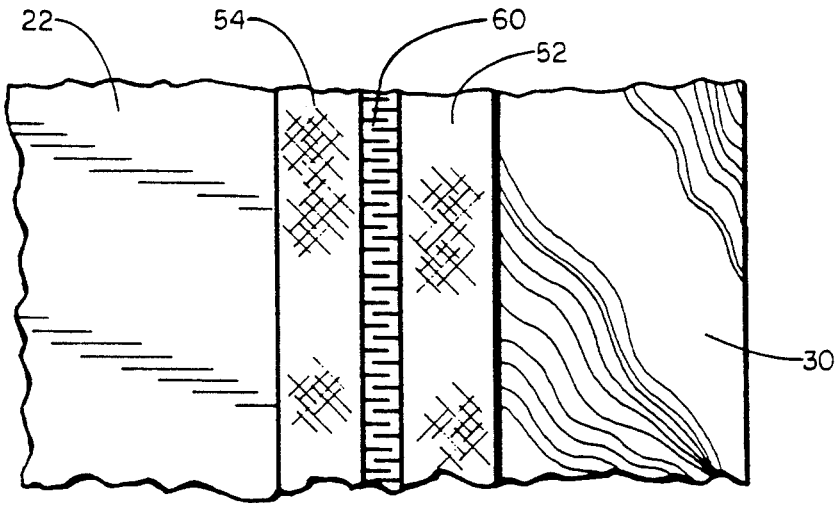
FIG. 3 is a partial elevational view of the membrane and the means for concealing the membrane fastener seen in FIG. 2.

A first half 56 of a slide fastener 60 is mounted on a free longitudinal edge 66 of the first elongated web 52. A second half 58 of the slide fastener 60 is mounted on a free longitudinal edge 68 of the second elongated web 54. The first and second halves, 56 and 58, of the slide fastener 60 are selectively interengaged over the elongated strap 48 and row of staples 50. Through the use of the slide fastener 60 along the length of the edge 42 of the membrane 22, the elongated strap 48 and staples 50 are effectively hidden from view, thereby creating a more aesthetically pleasing chair 12. What the observer sees is only the slide fastener 60 along the edge of the membrane 22 and the side frame 30, as seen in FIG. 3.

The invention also extends to the method for assembling the chair 12. The method comprises the steps of first laying the edge 42 of the membrane 22 in the groove 44 of the side frame 30. Next, the membrane 22 is fastened to the side frame 30 by the second fasteners or staples 46. The first longitudinal edges, 62 and 64, of the first elongated web 52 and second elongated web 54 are stitched to the elongated strap 48 and placed on top of the edge 42 of the membrane 22 and the row of staples 46 along the groove 44. The elongated strap 48 and the first and second webs, 52 and 54, are fixedly attached to the side frame 30 in the groove 44 by a plurality of first fasteners such as staples 50. Thereafter, the first and second halves, 56 and 58, of the slide fasteners 60 are selectively engaged to enclose the elongated strap 48 and staples 50, thereby concealing the strap 48 and fasteners in the groove 44.

This method may be modified by eliminating the second set of staples 46 and merely arranging the edge 42 of the membrane 22, the first and second elongated webs, 52 and 54, and the elongated strap 48 in the groove 44 and securely fastening these elements by a single set of staples 50.

This method may also be modified by utilizing a single elongated web for the slide fastener 60, rather than the two webs as described above. When using a single web, the first and second halves, 56 and 58, of the slide fasteners 60 are mounted on the opposing longitudinal edges of the web. The centerline of the web would be placed beneath the elongated strap 48 and then fastened to the side frame 30 by fasteners as described above. Thereafter, the first and second halves, 56 and 58, of the slide fastener 60 can be engaged to conceal the elongated strap 48 and fasteners.

The invention may be further modified by eliminating the elongated strap and using a single web. The center line of the web would be fastened to the side frame 30 by the fasteners as described above. Thereafter, the first and second halves, 56 and 58 of the slide fastener 60 which are mounted on the opposed edges of the web can be engaged to conceal the row of staples 50.

Figure 6:
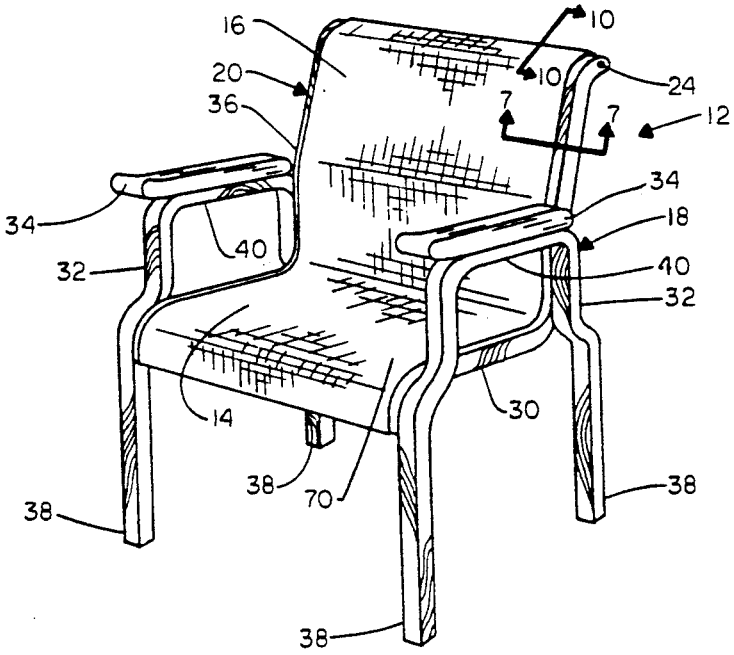
FIG. 6 is a perspective view of a second embodiment of the chair according to the invention with an upholstery pad mounted thereon.
Figure 7:
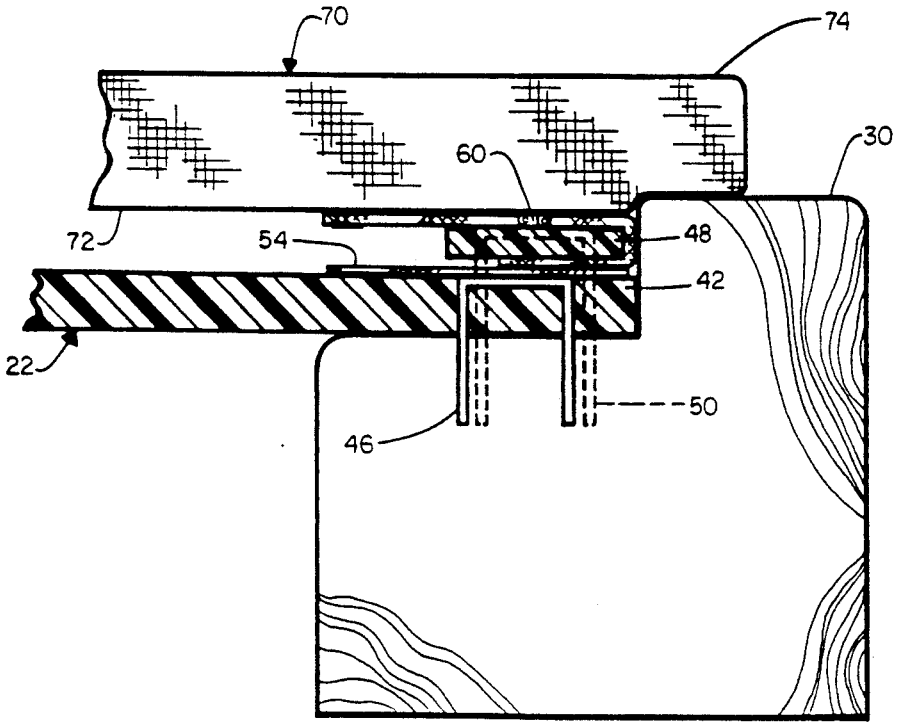
FIG. 7 is a partial sectional view of the upholstery pad and membrane fastener according to the invention, taken along lines 7—7 of FIG. 6.
Figure 8:
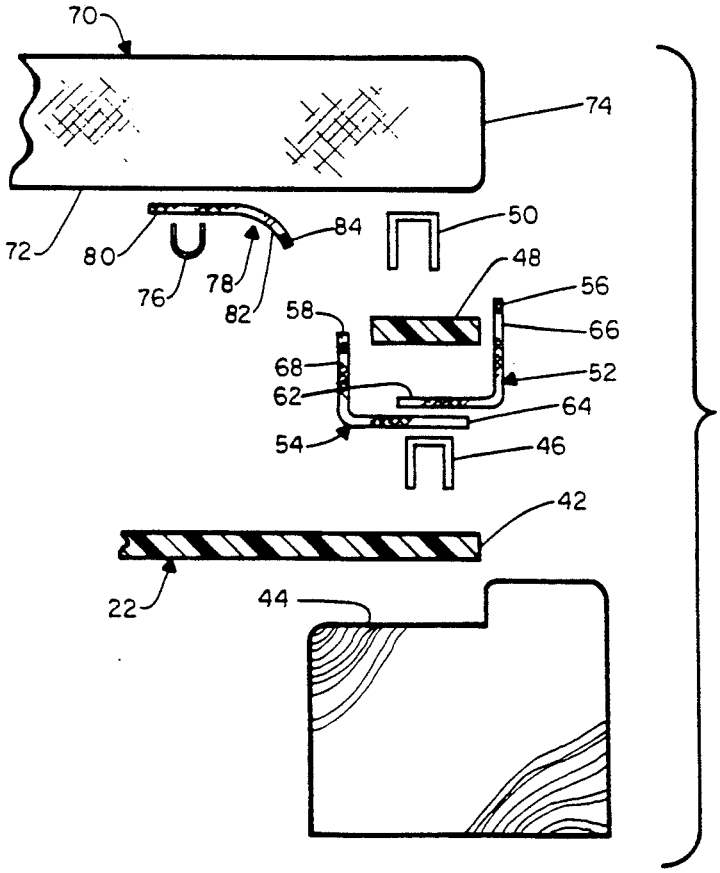
FIG. 8 is an exploded view of the upholstery pad and membrane fastener as seen in FIG. 7.

A second embodiment of the fastener for the chair 12 is shown in FIGS. 6–8. Elements which are common to the first embodiment utilize the same reference numerals in the following description.

The second embodiment of the chair 12 similarly comprises a seat 14, a back 16 and first and second support members 18 and 20. The first and second support members are maintained in their spaced parallel relationship by transverse members 24 mounted at the leading edge of the seat 14, at the top edge of the back 16 and at the junction between the seat 14 and back 16. In addition, the membrane 22 spans the space between the first and second support members, 18 and 20, to provide support for the occupant.

The second embodiment differs from the first in that an upholstery pad 70 is mounted to the chair 12. As in the first embodiment, the longitudinal edge 42 of membrane 22 is mounted in the groove 44 of the side frames 30 by a plurality of second fasteners such as staples 46. In addition, an elongated strap 48 is fixedly attached to the side frame 30 on top of the edge 42 of the membrane 22 by a plurality of first fasteners such as staples 50. The first longitudinal edge 62 of the first elongated web 52 is stitched to the elongated strap 48 and the membrane 22. The first longitudinal edge 64 of the second elongated web 54 is stitched to the elongated strap 48 and the membrane 22. The second embodiment of the chair also incorporates a third elongated web 78 which is attached to a lower surface 72 of the upholstery pad 70. The first longitudinal edge 80 of the third web 78 is attached to the pad 70 by suitable means such as threaded stitching 76 or adhesive.

The third elongated web 78 is preferably spaced inward from an outboard edge 74 of the upholstery pad 70. The first half 56 of the slide fastener 60 is mounted at the free longitudinal edge 66 of the first elongated web 52 and a second half 84 of the slide fastener 60 is mounted at a free longitudinal edge 82 of the third elongated web 78.

After the membrane 22 has been mounted in the groove 44 by the staples 46 and the first elongated web 52, second elongated web 54 and elongated strap 48 have been mounted to the side frame 30 by staples 50, then the halves of the slide fastener 60 on the first web 52 and third web 78 may be selectively interengaged to attach the upholstery pad 70 to the side frame 30. Because the third web 78 is attached to the pad 70 at a point spaced inward from the outboard edge 74 of the upholstery pad 70, the pad 70 lies on top of the staples 50, the elongated strap 48, and the slide fastener 60. In this configuration, the upholstery pad 70 serves to conceal the fastening means from view to create a more aesthetically pleasing chair 12.

As seen in FIGS. 7 and 8, the third elongated web 78 is mounted such that the free edge 82 is outwardly directed and the free edge 66 of the first web 52 is inwardly directed. It is understood that this relationship may be reversed provided the pad 70 extends far enough to cover the slide fastener 60 and its associated webs.

The benefit of utilizing the first, second and third webs, 52, 54 and 78, is the enhanced versatility of a single design of the chair. In the manufacturing process, the chair frames could be made up identically, regardless of whether they would be upholstered or unupholstered. One simply adds upholstery of a given choice of fabric and color to the standard chair base. Further, users of the chair without the upholstery pad 70 could later decide to add an upholstery pad 70 and no modification of the structure of the chair would be necessary. Alternatively, the users can change or clean the upholstery by simply removing the upholstery and closing the slide fasteners 56, 58 over the staples 50. The user would merely disengage the slide halves on the first and second webs, 52 and 54, and engage the slide halves on the first and third webs, 52 and 78. Similarly, a user who has an upholstery pad 70 mounted on the chair, can remove the pad at any point in time and utilize the first and second webs, 52 and 54, to conceal the fasteners.

In the second embodiment disclosed above, the second web 54 serves little or no function other than being available for use when the pad is removed as discussed above. After the upholstery pad 70 is mounted to the side frame 30, the second web is concealed by the upholstery pad 70 and is not used to mount the pad 70 to the side frame 30. Therefore, the second web 54 could be eliminated from the second embodiment without affecting the structure or function of the elements of the second embodiment, except for limiting he versatility of the chair.

The invention also extends to the method for assembling the second embodiment of the chair 12. The chair is assembled by first placing the edge 42 of the membrane 22 in the groove 44 of the side frame 30. Then, the edge 42 is fastened to the side frame 30 by the plurality of second staples 46. Next, the first longitudinal edge 62 of the first elongated web 52 is stitched to the elongated strap 48 and then placed on top of the staples 46 in the groove 44. The elongated strap 48 and first elongated web 52 are attached to the side frame 30 by the plurality of first staples 50.

The second half 84 of the slide fastener 60 is attached to the lower surface 72 of the upholstery pad 70 such that it is spaced inwardly from the outboard edge 74. The third elongated web 78 is attached by suitable means such as stitching 76, or by a plastic heat weld process. The upholstery pad 70 is attached to the chair 12 by selectively engaging the first and second halves, 56 and 84, of the slide fasteners 60. Because the second elongated web 54 is spaced inward from the outboard edge 74 of the upholstery pad 70, the edge of the pad extends to and conceals the fasteners mounted within the groove 44.

The second embodiment may be modified similar to that described above for the first embodiment. First, the plurality of second staples 46 can be eliminated and the membrane 22 would be attached to the side frame 30 only by the plurality of first staples 50. Next, the elongated strap 48 could be eliminated from the fastening means. Finally, a single web could be utilized in place of the first elongated web 52 an second elongated web 54. The first half and second halves 56 and 58 of the slide fastener 60 are attached to opposing edges of the single web and engaged to conceal the fasteners from view.

Figure 9:
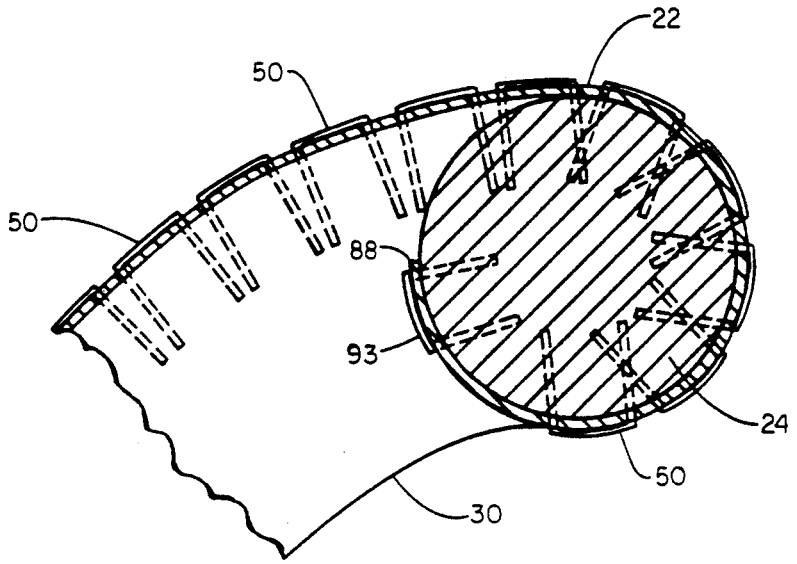
FIG. 9 is a partial sectional view taken along lines 9—9 of FIG. 1 and illustrating the means for attaching the top and the bottom of the membrane of the first embodiment of the invention.

The top and bottom edges of the membrane are secured to the transverse members 24 in a manner to conceal the edges from view. FIG. 9 shows the membrane as it is fastened to the transverse members 24 and the side frames 30. When no upholstery is to be mounted on the chair, the membrane 22 may be wrapped around the entire radius of the transverse members and the upper end of the side frame 30. The first staples 50 can substantially traverse the circumference of the rounded end of the side frames 30 to wrap the opposed edges 42 of the membrane 22 to the underside of the side frame 30. A plurality of transverse member staples 93 may be mounted along the longitudinal axis of the transverse member 24 to fixedly attach the portion of the membrane 22 lying between the two opposed edges 42 to the transverse member 24. By rolling the end of the membrane 88 around the transverse member 24 and the rounded ends of the side frames 30, the end of the membrane 88 is effectively concealed from view.

Figure 10:
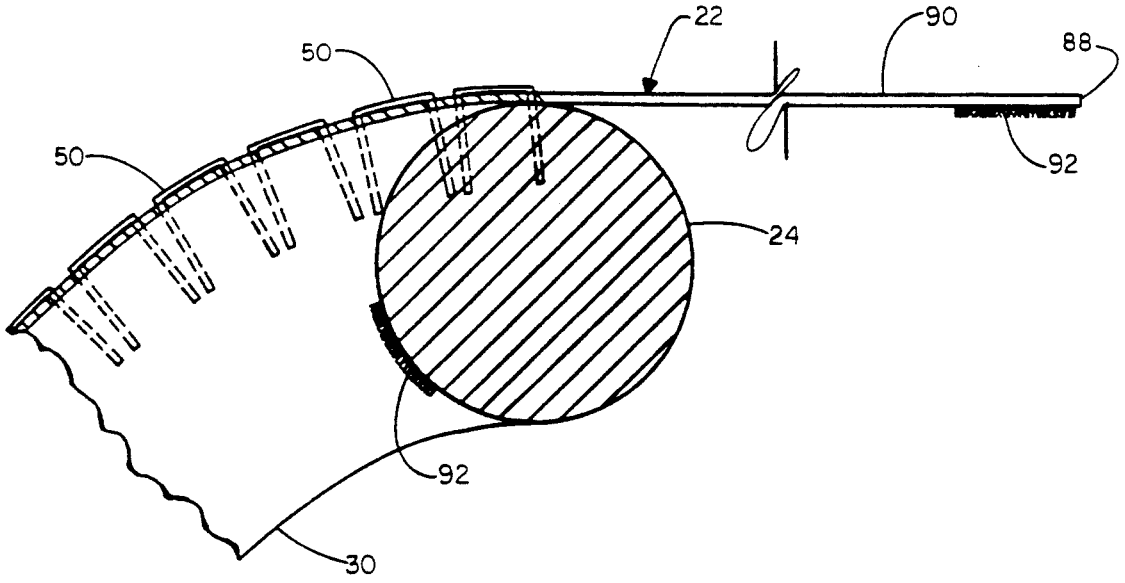
FIG. 10 is a partial sectional view similar to FIG. 9 and illustrating the means for attaching the top and bottom of the membrane of the second embodiment.

If the chair incorporates an upholstery pad 70 then the end of the membrane 88 can be mounted differently to the transverse members 24 at the top and bottom of the chair in order to accommodate easy attachment and removal of the upholstery. As seen previously, the upholstery pad 70 can be mounted to the chair 12 by an interlocking slide fastener 60. The second half of the slide fastener 84 attached to the upholstery pad 70 is more easily mounted to the first half of the slide fastener 56 attached to the chair if the staples 50 do not traverse the entire radius of the end of side frame 30. As seen in FIG. 10, the row of staples 50 terminate a short distance from the end of the membrane 88. A flap of the membrane 90 is left unattached at both the top and bottom edges of the membrane 22 to permit easier engagement of the slide fastener 60. After the upholstery pad 70 (not shown in FIG. 10) is attached, the flap 90 is rolled under the radius of the transverse member 24 and held in place by a selective fastener such as VELCRO 92 or snaps. In order to remove the upholstery pad, the flap 90 is pulled out from the underside of the transverse member 24, thereby exposing the end of the slide fastener.

Figure 11:
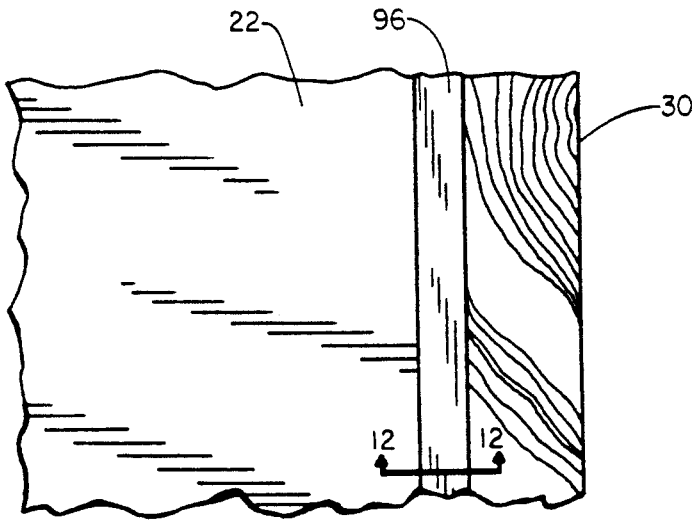
FIG. 11 is a partial elevational view of a membrane mounted to the side frame of the chair according to a third embodiment of the invention.
Figure 12:
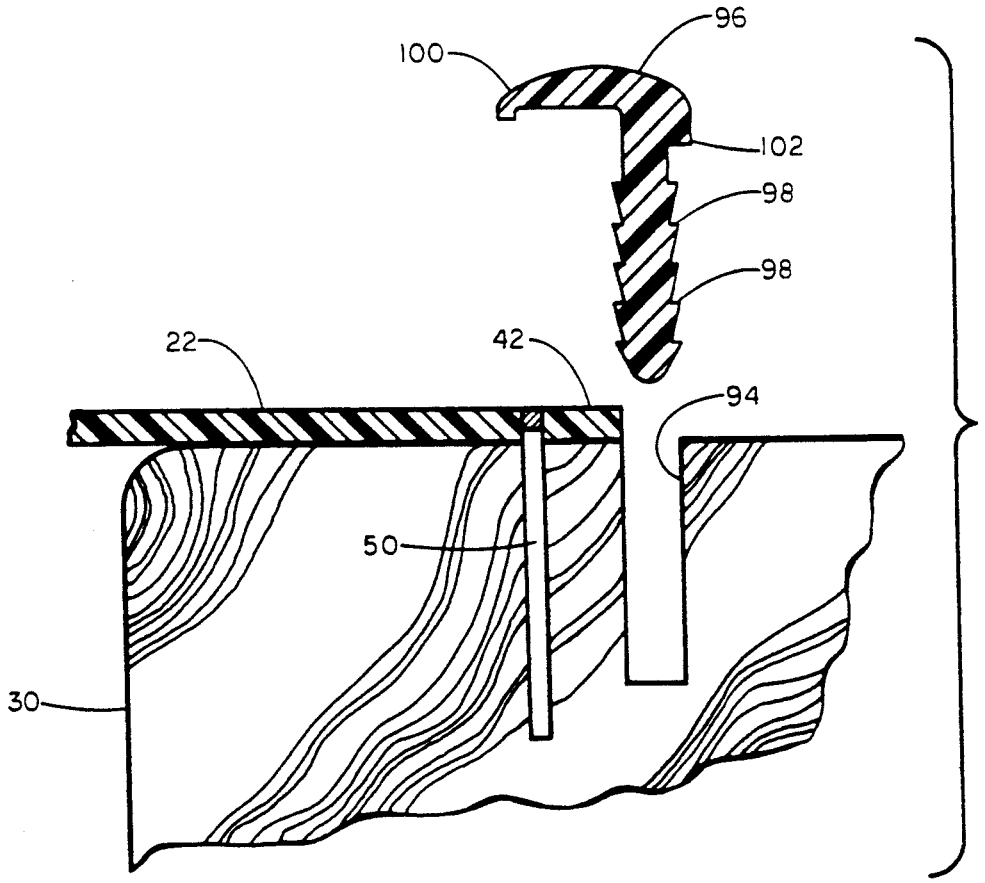
FIG. 12 is a partial exploded view of the seat membrane fastener seen generally along lines 12—12 of FIG. 11.

A third embodiment of the fastener for the chair 12 is shown in FIGS. 11 and 12. Elements which are common to the first embodiment utilize the same reference numerals in the following description.

The third embodiment of the chair 12 similarly comprises a seat 14, a back 16 and first and second support members 18 and 20. The first and second support members are maintained in their spaced parallel relationship by transverse members 24 mounted at the leading edge of the seat 14, at the top edge of the back 16 and at the junction between the seat 14 and back 16. In addition, the membrane 22 spans the space between the first and second support members 18 and 20 to provide support for the occupant.

The third embodiment differs from the first in the means in which the fasteners are shielded from view. As in the first embodiment, the longitudinal edge 42 of the membrane 22 is mounted to the side frames 30 by a plurality of first fasteners such as staples 50. In this embodiment, the staples 46 are aligned parallel to the sides of the side frame 30. A groove 94 is machined into the top surface of the side frame 30. The groove 94 extends the entire length of the side frames 30 immediately adjacent to the terminal edge 42 of the membrane 22. An elongated strip or extrusion 96 is securely mounted within the groove 94 to hide the staples 46 and the edge of the membrane 22 from view. Preferably, the extrusion 96 is L-shaped.

The extrusion 96 has a depending leg with a plurality of barbs 98 formed thereon which permit insertion of the leg into the groove 94 but resist removal therefrom. The extrusion 96 has two horizontal flanges, 100 and 102, extending outwardly from the longitudinal axis of the extrusion. The first horizontal flange 100 extends far enough to conceal the terminal edge of the membrane 22 and the row of staples 46 from view. The second horizontal flange 102 extends in the opposite direction from the first flange 100 a short distance and helps to conceal the groove 94 from view.

In order to prevent the inadvertent removal of the extrusion 96 from the groove 94, the terminal ends (not shown) of the elongated strip 96 may be fastened to the underside of the side frames 30 by extrusion staples (not shown). The most likely point at which the extrusion 96 may inadvertently be removed from the groove 94 is the terminal ends of the strip 96.

The method for fastening the membrane 22 according to the third embodiment comprises the steps of machining a groove 94 in the surface of the side frame 30, mounting the membrane 22 to the side frame 30 adjacent the groove 94 by a plurality of staples 46 and finally forcing the extrusion 96 into the groove 94 along the length of the side frame 30. The machining and membrane mounting steps can be reversed if desired.

The third embodiment for fastening the membrane provides an easily installed means for concealing the membrane fastener from view.

Figure 13:
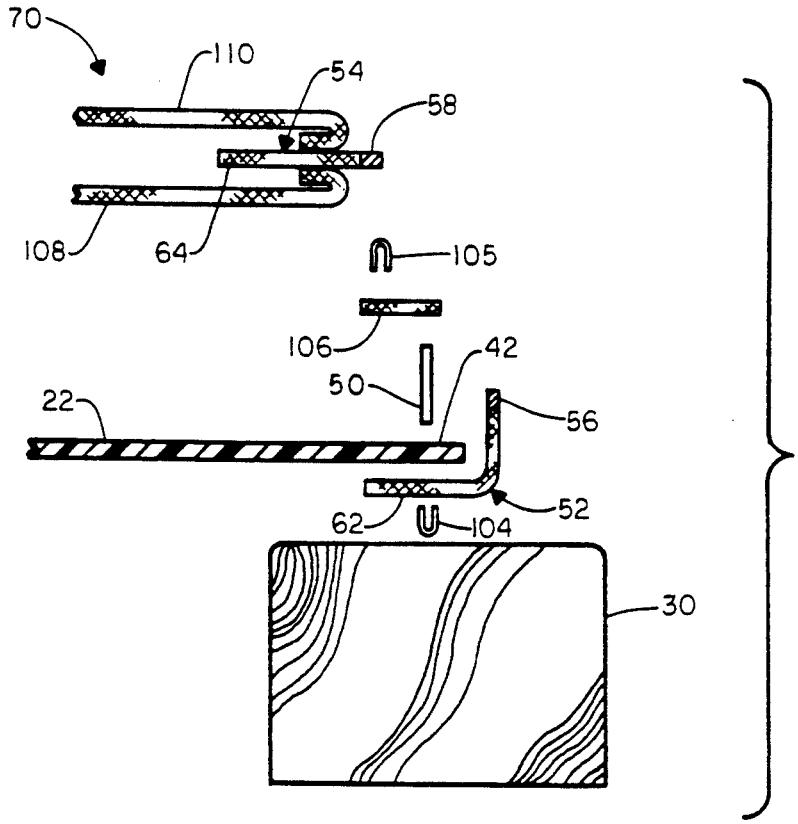
FIG. 13 is a partial exploded view of a fourth embodiment of the seat membrane and upholstery fastener according to the invention.
Figure 14:
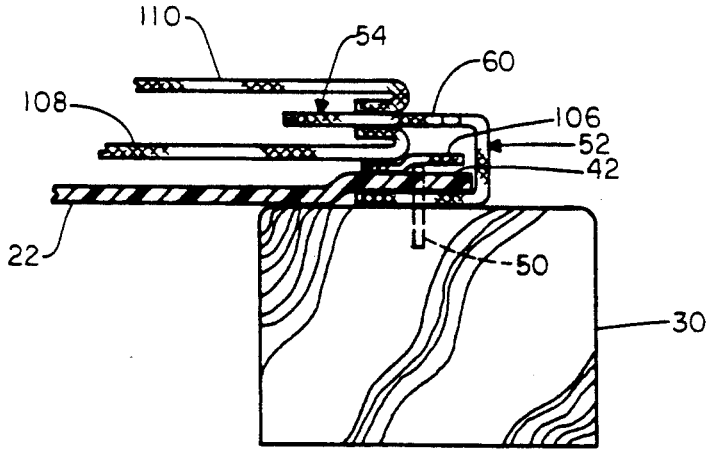
FIG. 14 is a partial sectional view of the fourth embodiment of the assembled membrane fastener seen in FIG. 13.

A fourth embodiment of the fastener for the chair 12 is shown in FIGS. 13 and 14. Elements which are common to the first embodiment utilize the same reference numerals in the following description.

The fourth embodiment of the chair 12 similarly comprises a seat 14, a back 16 and first and second support members 18 and 20. The first and second support members are maintained in their spaced parallel relationship by transverse members 24 mounted at the leading edge of the seat 14, at the top edge of the back 16 and at the junction between the seat 14 and back 16. In addition, the membrane 22 spans the space between the first and second support members 18 and 20 to provide support for the occupant.

The fourth embodiment differs primarily from the first by the elimination of the elongated strap 48. In the fourth embodiment, the first elongated web 52 is mounted below the membrane 22 such that the free longitudinal edge of the first web 66 and the first half of the slide fastener 56 are adjacent the edge 42 of the membrane 22. The first elongated web is mounted to the membrane by suitable fasteners such as stitching 104. A fabric strip 106 is stitched to the upper surface of the membrane 22 adjacent to the edge 42 of the membrane 22 through stitching 105. As seen in FIG. 14, the inboard side of the fabric strip 106 is stitched to the membrane 22 such that the strip 106 covers the edge 42 of the membrane 22, but can be peeled back to expose it.

The membrane 22 and the first elongated web 52 are mounted to the side frames 30 by a plurality of fasteners such as staples 50. The staples 50 are preferably parallel to the sides of the side frames 30. In mounting the membrane, the fabric strip 106 is first folded back, thereby exposing the edge 42 of the membrane 22. The staples 50 are inserted and then the fabric strip 106 folds down on top of the row of staples 50, thereby concealing them from view.

The second half 58 of the slide fastener is mounted to the second elongated web 54. The second elongated web 54 is in turn stitched directly to the upholstery pad 70. In this embodiment, the upholstery pad comprises a base layer 108 and an outer fabric layer 110. The second elongated web is stitched to the base layer 108 and fabric layer 110 in such a manner to conceal the bulk of the web 54 from view. The web 54 is placed between the base layer 108 and fabric layer 110 such that the second half 58 of the slide fastener is sandwiched between the base layers 108 and fabric layer 110. The first longitudinal edge 64 of the second web extends outwardly from the edges of the layers. The edges are stitched and then the base layer and fabric strip are inverted, thereby exposing the second half 58 of the slide fastener and concealing the first longitudinal edge 64 of the second web.

After the membrane 22 has been mounted to the side frames 30 as described above, the first half 56 of the slide fastener and the second half 58 of the slide fastener ca be fastened together, thereby attaching the upholstery to the chair.

Heretofore, there were several different techniques available for fastening a membrane or upholstery pad to a chair frame. However, the fasteners and method of assembling the chair according the invention provides a simple and aesthetically pleasing chair construction not seen in the prior art. In the first embodiment, the staples are concealed from view, all that is seen is the slide fastener which extends the length of the side frame. In the third embodiment, the staples are concealed from view by the extrusion. In the second and fourth embodiments, the upholstery pad is attached to the side frame by the slide fastener in such a manner that neither the staples nor the slide fasteners are exposed, thus creating a more aesthetically pleasing chair.

While particular embodiments of the invention have been shown, it will be understood, of course, that the invention is not limited thereto since modifications may be made by those skilled in the art, particular in light of the foregoing teachings. Reasonable variation and modification are possible within the foregoing disclosure without departing from the spirit of the invention.

The embodiments of the invention in which an exclusive property or privilege is claimed are defined as follows:

1. In an article of furniture comprising two support members parallel to and spaced from each other, a membrane having two opposed edges extending between and attached at the opposed edges to said support members to support an occupant, the improvement comprising;

each of said opposed edges is covered by an elongated web having one half of a slide fastener attached to one elongated edge of the web and another half of the slide fastener attached to another elongated edge of the web and parallel to said one half of said slide fastener; and a plurality of first fasteners mounting the web and membrane to at least one of the support members;

the two halves of the slide fasteners are selectively interengagable to conceal the fasteners beneath the edges of the elongated web when the slide fasteners are zipped together.

2. An article of furniture according to claim 1 and further comprising an elongated strap overlying the web and narrower than the web and said first fasteners extending through said elongated strap.

3. An article of furniture according to claim 2 further comprising a plurality of second fasteners mounting only said membrane to an upper surface of said support members.

4. An article of furniture according to claim 3 wherein said second fasteners comprise staples.

5. An article of furniture according to claim 1 wherein said first fasteners comprise staples.

6. An article of furniture according to claim 1 further comprising a groove in each of said two support members for receiving said opposed edges of the membrane.

7. An article of furniture according to claim 6 wherein said groove is formed on an upper surface of said support member.

8. An article of furniture according to claim 1 wherein said first fasteners extend the length of the opposed edges of the membrane.

9. An article of furniture according to claim 1 wherein said article of furniture comprises a chair having a seat and a back.

10. An article of furniture according to claim 9 wherein said membrane is attached to said seat and said back by said first fasteners.

11. In a chair comprising a seat, a back, two support members parallel to and spaced from each other for supporting one of said seat and back, a membrane extending between and fastened at opposed edges to said support members to support an occupant, an upholstery pad overlying said membrane attached to said support members, the improvement comprising;

an elongated first web having one half of a slide fastener attached to one elongated edge thereof and extending along each opposed edge of said membrane;

a plurality of first fasteners mounting the first web and membrane to said support members; and an elongated second web having another half of a slide fastener attached to one elongated edge of the second web, said elongated second web securely attached to said upholstery pad;

said elongated edge of the first web and one elongated edge of the second web are directed toward each other so that the slide fasteners of said elongated first and second webs can be zipped together;

wherein the two halves of the slide fasteners are selectively interengaged over the first fasteners such that the upholstery pad conceals the first fasteners and said slide fastener fixedly attaches the upholstery pad to the support member.

12. A chair according to claim 11 and further comprising an elongated strap overlying a portion of the first web with said first fasteners extending through said strap and said first web.

13. A chair according to claim 11 wherein said second elongated web is spaced inwardly from an outer edge of said pad and said first elongated web extends outwardly from an opposed edge of said membrane.

14. A chair according to claim 11 further comprising a plurality of second fasteners fastening only said membrane to said support members.

15. A chair according to claim 14 wherein said second fasteners comprise staples.

16. A chair according to claim 14 and further comprising a groove in each of said two support members for receiving said opposed edges of the membrane.

17. A chair according to claim 16 wherein said groove is formed on an upper surface of said support member.

18. A chair according to claim 11 wherein said first fasteners comprise staples.

19. A chair according to claim 11 wherein said fasteners extend along the length of the opposed edges of the membrane except a short distance from a third edge of the membrane.

20. A chair according to claim 19 wherein said third edge of the membrane is attached to a transverse member of the chair by a selective fastener.

* * * * *